United States Patent [19]

Grams

[11] Patent Number: 4,871,335

[45] Date of Patent: Oct. 3, 1989

[54] WATER-SKI LOCATOR DEVICE

[76] Inventor: Charles E. Grams, 11417 W. 59th Ave., Arvada, Colo. 80004

[21] Appl. No.: 193,901

[22] Filed: May 13, 1988

[51] Int. Cl.[4] ..... A63C 15/00; A63C 15/06

[52] U.S. Cl. ..... 441/68; 116/26; 116/DIG. 11; 441/70

[58] Field of Search ..... 441/6, 68, 70, 73, 79, 441/136; 116/DIG. 11, 1, 26; 434/253

[56] References Cited

U.S. PATENT DOCUMENTS

| | | | |
|---|---|---|---|
| 2,716,246 | 8/1955 | Billingham | 441/70 |
| 3,031,697 | 5/1962 | Klein | 9/310 |
| 3,066,326 | 12/1962 | Collins | 9/310 |
| 3,096,530 | 7/1963 | Almgren | 441/70 |
| 3,212,113 | 10/1965 | Barrett | 9/310 |
| 4,389,200 | 6/1983 | O'Brien | 441/70 |

*Primary Examiner*—Sherman D. Basinger
*Attorney, Agent, or Firm*—Dorr, Carson, Sloan and Peterson

[57] ABSTRACT

A water-ski locator device is comprised of a buoyant body fixed in position on the top surface of the water-ski's toe piece by a number of straps. So positioned, the buoyant body does not create water drag while the ski is in use. The device is also particularly adapted to restore the body uppermost over the ski and to visibly project above the water's surface in the event the ski becomes detached, or is purposely left by the skier, and comes to rest in an upside down orientation, i.e., if the ski initially comes to rest, as a water-ski is otherwise often inclined to do, with its bottom surface floating on the water and its shoe piece facing downward.

6 Claims, 9 Drawing Sheets

WATER-SKI LOCATOR DEVICE

FIELD OF THE INVENTION

This invention generally relates to devices for making detached water-skis more visible in the water, and hence more easily retrievable and/or less hazardous. This invention is particularly concerned with those water-ski locator devices which function by providing added buoyancy to a detached water-ski.

BACKGROUND OF THE INVENTION

In recent years the sport of water-skiing has become an increasingly popular form of water recreation. It is particularly enjoyable in large open expanses of water which permit high speed towing over long distances while performing manuevers which range over wide lateral areas. For example, in one such manuever an advanced water-skier will start on two skis, but then, when proper planing is obtained, the skier will drop or leave one ski behind and continue to be towed on one ski. Hence, large distances may be traveled away from the point where the one ski was left behind. Such large expanses and wide ranging manuevers do however create some drawbacks which, even at best, represent nuisances to water-skiing enthusiasts. For example, most open expanses of water are not usually flat calm. Consequently, detached skis are often difficult to see because even small wave actions tend to obscure a clear view of the water's surface. Moreover, since water-skis are generally designed with easy detachment from the skier as a paramount safety consideration, and since one common water-skiing manuever is to purposely step out of one water-ski and continue to ski on the remaining ski, a detached ski may come to rest a considerably distance from a downed skier. All this goes to say that at the speeds and distances involved in such manuevers and/or in the confusion of a fall, a detached water-ski is often difficult to locate, either from the nearby, but low-level vantage point of the skier in the water, or from the higher but usually farther distance of the towing boat. These difficulties are also exacerbated if a detached water-ski happens to come to rest upside down with its shoe piece facing down in the water. Under these circumstances the ski, which is typically less than an inch thick, takes on the character of a flat plank-like object and only a small fraction of an inch of its thickness will lie above the water's surface. In other words, an upside down, unattended water-ski is essentially submerged, and thus largely out of sight. This circumstance represents a far more serious problem than searching for a lost ski. Such an object, floating just at the water's surface, in an area trafficked by high-speed boats and skiers, represents a serious safety hazard.

In order to better understand some of the problems associated with locating water-skis in open water, and Applicant's particular approach to these problems, a little discussion of basic hydrostatics and hydrodynamics may be in order. We can begin this discussion by noting that the basic principle involved in hydrostatics is that of Archimedes: a floating object displaces its own weight in water. FIGS. 1(*a*), 1(*b*) and 1(*c*) are offered to further help explaining the hydrostatic principles employed in applicant's water-ski locator device. These three figures depict a vertical cross-section of a very generalized floating hull 10 in three hydrostatic states.

In all these figures, M represents the position of the center of mass of the entire assembly, out of the water. The force of gravity acts on the total assembly as if all of its mass were concentrated at this point, which, for a fixed rigid structure, remains in the same position relative to the assembly structure at all times. Point C represents the position of the center of buoyancy, the center of mass of water actually displaced by the immersed assembly at any time. This position is constantly moving as the structure lies at different attitudes as winds and waves cause it to roll and pitch in the water. Through Point C, there is focused, directly upwards, a force equal to the mass of the water displaced.

FIG. 1(*a*) shows a hull 10 laden with a cargo 11 in its bottom. In this state, the center of buoyancy C of the hull/cargo system lies above its center of mass M. For the sake of simplicity, both C and M are assumed to lie on the ship's vertical centerline 12—12'. When the center of buoyancy C and the center of mass M are so arranged with respect to each other, disturbances from a vertical orientation tend to raise the center of mass M relative to the center of buoyancy C. Such a disturbance causes the natural restorative forces present in this C above M state to bring the system back to its original condition. Thus, this is a hydrostatically stable situation. In other words, FIG. 1(*a*) is intended to show that a concentration of weight 11 in the lower portions of such a hull 10, symmetrical about center line 12—12', lowers the system's center of mass to a point M where a force, depicted by a downward pointing arrow, is assumed to be concentrated. Note that point M also lies well below the midpoint of the hull height H. The force directed downward from point M is opposed by a force, depicted by an arrow projecting upward from point C, which is provided by buoyancy. Again, this state, wherein point C lies above point M, is stable; consequently hull 10 floats in the erect orientation shown in FIG. 1(*a*) i.e., center line 12—12' is vertical.

FIG. 1(*b*) and 1(*c*) depict two possible changes to the stable hydrostatic arrangement of FIG. 1(*a*). FIG. 1(*b*) shows how a high cargo 14 placed on the deck of hull 10 will raise the center of mass M above the center of buoyancy C. This also forces the hull 10 deeper into the water and consequently lowers its center of buoyancy C. This condition is unstable: that is to say the forces exerted during any heeling action are offset from direct axial opposition, thus forming a rotational moment about this offset. This circumstance causes the list depicted in FIG. 1(*b*). In other words, in the high load situation depicted in FIG. 1(*b*), a force, at the center of mass M, is exerted downwardly at a point above the upward force exerted at the center of buoyancy C. This condition causes a "couple" depicted by the two curved arrow emanating from points M and C respectively. Again, this condition is unstable; hence the hull 10 tends to capsize as indicated.

FIG. 1(*c*) shows the case where the hull 10 is so light (load 11 is removed) that, overall, it floats with its center of mass M above its center of buoyancy C as well as above water line 16. Here again, because point M is above point C, a couple is created and the hull 10 tends to capsize. As will be pointed out in greater detail, Applicant's water-ski locator device is deliberately designed to create this particular hydrostatically unstable situation if the detached ski happens to come to rest upside down i.e., with the ski's shoe piece facing downward in the water. However, before more fully discussing this aspect of Applicant's water-ski locator device, it also would be helpful to note how the prior art addressed the problems associated with free floating water-skis.

Various devices for changing the hydrostatics of floating water-skis have been proposed in order to make them more visible. Generally they involve the use of a variety of floats, buoyancy-providing core materials and water-ski locator attachments. Of these devices, three patent references might well be cited as being the most representative of the prior art methods of making detached water-skis more visible in the water. For example, U.S. Pat. No. 3,031,697, teaches the use of an especially buoyant ski tip used in conjunction with a weight added to the stern end of the water-ski. This arrangement causes the bow tip of the ski to project from the water when the ski is floating free in the water. U.S. Pat. No. 3,066,326 also discloses the use of an especially buoyant ski tip cover which can be detachably mounted t the bow end of the ski. U.S. Pat. No. 3,212,113, proposes use of a ball-like float which is attached to a rope tethered to the top side of the stern end of a water-ski.

All of these prior art water-ski locator devices, however, have at least one common drawback which applicant's invention seeks to overcome. To some degree, each of these prior art devices remains in drag-creating contact with the water during skiing operations. Such drag is usually regarded as undesirable by most water-skiers. Moreover, some of these prior art water-ski locator devices also change the normal contour of the ski itself. Hence, water-skis equipped with such drag creating and/or contour-changing locator devices do not "feel" the same to the water-skier as they would without them.

A beginning appreciation of applicant's solution to the drag problem created by such prior art water-ski locator devices can be gained by first considering the hydrodynamics of a ski traveling through the water. This action is described by Bernouilli's Principle even though it does not act in the same way as the lift provided to an airplane wing due to motion through a homogenous fluid/air. In the case of a moving hull such as a water-ski under strong towing action, there is movement along the interface of two fluids (air and water) having markedly different densities. Here the relevant forces combine to produce the phenomenon known as "planing".

FIGS. 2 and 3 respectively portray a plan and a side view of the normal disturbance of tee water's surface during water-skiing. Under the action of a pulling force 13, the ski 19 is pulled through the water 16, and the ski's velocity is converted into hydrostatic head depicted as arrows 23 along the flat underside of the ski below the waterline. This pulling action causes the ski to throw a bow wave 20 which propagates outwardly directly from the ski-water interface generally in the area slightly forward from ski's toe piece 22. Water is thrown straight outward from the ski's bottom side until, somewhere in the region behind the skier's foot, an after portion 24 of the ski is in the water deep enough to permit a supersurface wave 26 to roll in toward the stern. FIG. 3 is, among other things, specifically intended to show that no drag creating contact with the water is made near a front cuff region 27 as the ski 19 advances under the towing or pulling action 18 provided by a boat, not shown. This wave behavior and lack of water contact in the front cuff region 27 can be verified by observing that expert skiers, as a "trick", are able to quick-start, fully dressed, from a dry beach, ski in water and then return to the beach without soaking their trouser cuffs.

Therefore, Applicant has concluded that since any unnecessary drag and/or changes in the water-ski's contour will be, to some degree, detrimental to smooth water-skiing actions and since the "front trouser cuff region" 27 is not in contact with the water during water-skiing operations, this would be a particularly advantageous place for placement of a water-ski locating device because when located here, it would not create drag or otherwise interfere with the water-ski's normal hydrodynamics. Moreover, the positioning of a buoyant water-ski locator device in this front trouser cuff region 27 will also better serve to "roll over" a water-ski if it comes to rest upside down ala the coupling principles depicted in FIG. 1(*c*). Such a rolling over, for reasons which are hereinafter more fully described, will make the locator device, and hence the ski itself, much more visible in the water.

SUMMARY OF THE INVENTION

The water-ski locator device of this patent disclosure is specifically adapted for positioning on the ski's toe piece, at or near the front arch or front cuff region, at about ankle height of the skier's foot. Applicant's water-ski locator device can be associated with any conventional recreational water-ski (hereinafter referred to as a "ski" or "skis"). Preferably the association of applicant's device and the water-ski will be made in a readily detachable manner. When attached however, the locator device and ski should constitute a unitary assembly. Hence, when floating in the water, the herein disclosed locator device serves to elevate the entire locator device/ski assembly as a unit and thereby render the assembly more easily visible for recovery operations and/or reduce any subsurface hazard such a ski might otherwise create while it is adrift. Again, the buoyancy features of the herein disclosed device, in conjunction with its location on top of the toe piece of the ski will also serve to roll over the ski if it should come to rest in an upside down orientation. In other words, the roll over force is particularly effective if applied near the middle of the ski as opposed to being applied on either of its ends. This roll over effect is also enhanced by the fact that the locator device is located above the top surface of the ski. So positioned, the center of buoyancy C of an upside down ski/locator assembly is farther from its center of mass M. Hence the "couple" effect depicted in FIG. 1(*c*) is stronger.

In its most preferred embodiment the water-ski locator device of this patent disclosure comprises a water proof, generally rectangular shaped, buoyant body attached to the ski by means of an attachment means which locates the buoyant body substantially on the top surface of the toe piece, preferably near the upper top regions of the skier's foot and/or on the lower regions of the skier's shin, again, in what might be termed the "front cuff region" Most preferably the buoyant body will have a hollowed out, tunnel-like, region which fits over the curved top of the water-ski's toe piece. More preferably the buoyant body will be constructed in the form of an outside pouch which houses a body of buoyant material. In other words, the buoyant body can itself be the buoyancy-providing material, but more preferably the buoyant body is a closeable bag-like or pouch-like device completely filled with one or more buoyant materials. Solid, highly buoyant materials such as for example, polyurethane are highly preferred for this purpose. Thus, the pouch is preferably filled, but not tightly packed, with a light, buoyant, "life-preserver" type of non-rigid foam such as polyurethane or other so-called "closed" (non-waterlogging) foams having non-rotting, non-flammable, non-waterlogging characteristics. When used as the buoyant body, the pouch is most easily made closable by a zippered opening which extends around a portion of its outside perimeter. Hence in this preferred embodiment, the buoyant material e.g., a block of polyurethane is, in effect, housed in a zipped up pouch.

The shaped pouch is most conveniently constructed of a sturdy fabric such as nylon or canvas which is not easily subject to water damage by drying, rotting, or tearing. Most preferably the pouch, if employed as the buoyant body, also will be brightly colored (e.g., orange, red, yellow, etc.) by a light-fast and water-fast dye. Most preferably, the buoyant body's color will be provided by a luminescent dye such as "psychedelic orange", which will stand in sharp contrast to the blue/-green/brown colors typically exhibited by bodies of water.

The buoyant body may be of any geometric shape, but a preferred shape for this buoyant body is that of a generally rectangular solid. Its breadth will preferably approximate, or slightly exceed, the width of the ski itself at the toe piece region of the shoe. In position, the height of the buoyant body's top surface preferably will not exceed by more than about 6 inches, the height of the skier's ankle. When so positioned, the lower side of the buoyant body should be at least about one inch above the ski's top surface. The locator device's fore-to-aft length will generally extend forward from the skier's leg/foot arch along the center line of the ski for a distance such that its fore-to-aft length achieves the desired added buoyancy, bearing in mind that each cubic inch of volume will contribute approximately ½ ounce avoirdupois of lift. Generally speaking, when polyurethane is used as the buoyant body's material, the fore-to-aft length of the locator's buoyant body (e.g., a polyurethane filled pouch) will not extend beyond the front of a typical water-ski toe piece i.e., it will not extend forward more than about 9 inches. Thus for example such a locator device might be generally rectangular in shape and be from about 6 to about 12 inches wide, from about 2 to about 6 inches long fore-to-aft and from about 4 to about 6 inches high.

The bottom center region of the buoyant body also can be hollowed to provide a concave, tunnellike opening which approximates the shape of the top of the ski's toe piece such that, when the buoyant body is put in place over the top of the toe piece, the buoyant body will lie nearly flat i.e., it will lie more or less parallel to the top surface of the ski. Another preferred modification to the generally rectangular block configuration of the locator device would be to truncate the rear top corner of the block to form a face upon which useful information, e.g., name, address and phone number of the ski's owner, trademarks, mounting instructions etc. can be printed.

The buoyant body can be positioned at the upper regions of the toe piece by various positioning and/or attachment means. Thus, for example, it can be attached to the ski by permanently sewing a flexible, waterproof, rot-proof, etc., strap to the bottom of a pouch containing a buoyant block of polyurethane. This strap can be attached by Velcro®, laces, buckles etc. to another loop or strap which is securely connected to the ski. Again, an ideal material for both straps is a Nylon® or canvas provided with a backing made of the commercial hooked-surface Nylon® known as "Velcro"®. Various alternative methods of positioning the locator body may also be employed. For example a rubber strip which arches over the ski's toe piece can be provided with a semi-flexible rubber rib which projects from the strip's top surface and which is attached to the locator body in such a manner that the rib positions the locator body (e.g., the previously described pouch) over the upper regions of the toe piece in the desired front cuff region.

Applicant has found that two strap webbing system can provide a highly preferred method of attaching the locator device to the ski. When it is employed as the means of attaching the buoyant body to the ski, the webbing system can be attached to the ski at the foot plate mounts which are otherwise employed to hold down the toe piece of the water-ski's shoe. This toe piece mount is also a convenient place to attach those other positioning means (e.g., the alternative rubber arch and rib system which was mentioned and which will be more fully described in conjunction with FIG. 12) which may be employed to locate the buoyant body in the front cuff region of the skier's foot. Moreover, the buoyant body is most preferably attached to the toe piece by a webbing system which is capable of allowing the buoyant body to be quickly removed from the toe piece. Hence, a webbing system having at least one web or strap provided with detaching means such as Velcro, buckles, laces and the like is highly preferred.

One particularly preferred webbing system holds the pouch in the desired front cuff position by means of two straps. The first strap extends from one side of the toe piece to the other side to form a base arch which generally follows the curved, upper contour of the top surface of the toe piece. Preferably the first strap is attached to the same mounting plate which holds down or otherwise forms a part of the ski's toe piece. In practice the screws which typically hold down the toe piece and/or toe piece mount also can be readily employed to simultaneously hold down both the first strap and the toe piece. Most preferably, no excess length of the first strap should extend beyond the edge of the ski. Hence, no new holes need be drilled in the ski to mount the straps. Consequently, the locator device can be easily mounted to any ski with little or no modification to the ski and/or its associated toe piece. The second strap of such a two strap webbing system is most preferably looped under and through the arch formed by the first strap as it traverses the top surface of the toe piece between the left and right sides (as seen from the water-skier's perspective during skiing) of the mounting piece to which a ski's toe piece is normally attached. In other words the second strap passes under the arch of the first strap in a more or less perpendicular orientation to form a two-piece webbing system. Preferably the second strap is permanently attached to the pouch or other buoyant body. Moreover, the second strap is most preferably attached to the roof of the tunnel-like opening in the buoyant body in such a manner that the second strap is attached to the roof of the tunnel near the second strap's middle so that two ends of the second strap hang free from the roof of the tunnel. At least one of the two free ends should be long enough to be passed under the first strap. In a more preferred embodiment of this invention, both free ends are passed under the first strap and joined with each other. Applicant also has found that a webbing system having a first strap whose underside is made of Velcro and which arches over the toe piece between the two sides of the toe piece mounting plate can be conveniently engaged with a Velcro surface on the underside of the second strap which is attached to the pouch. The second strap may also be constructed with the top surface of one free end of the second strap provided with the Velcro's "hooked" surface and the under surface of the other free end of the second strap provided with the Velcro's "eyed" surface, or vice versa. This arrangement allows the second strap to form a closed loop under the arch of the first strap. In other words these straps engage by looping the pouch strap under the arch strap, Velcro-to-Velcro, at more or less right angles. No buckles or knotted laces need by employed in this Velcro-to-Velcro system. In any event, the mounting means should cause the bottom of the pouch to be positioned on top of the toe piece, preferably near the top arch of the skier's foot in the front cuff region at about ankle height. Again this positioning is greatly facilitated by a tunnel-like indentation shaped to approximate the contour of the top surface of the toe piece in which the top arch of the skier's foot would normally lie.

The length of the second strap should be sufficient to permit its two ends to be passed under the first arching strap and be secured by Velcro, buckles etc., and thereby link the first and second straps together snugly, but not necessarily under any significant tension, to form a buoyant body positioning means comprised of a two-strap webbing system.

Hence with this preferred mounting means, the locator device described above can be supplied with the skis or as a separate kit whose parts can be added to existing skis without having to disturb any aspect of the ski's design or construction. Nothing more than a few insignificant ounces of weight are added, and in a position imposing no impedance or drag to normal ski operations. In fact, this locator device may be easily demounted and/or different floats may be substituted according to local water-skiing conditions. Again it should be noted that, in normal skiing operations, the wave distribution pattern previously noted does not come into contact with the pouch; hence the skier is in no way discommoded nor forced to alter his normal skiing style or habits, and as previously noted, the skier is not aware of any significant weight attached to his body or to the ski.

Thus, it is not until the skier is out of the ski(s) that the buoyant body comes into contact with the water and its buoyancy becomes effective under the threat of submergence. When this does happen the buoyant body is located well above the water surface if the ski comes to rest with the ski's shoe piece right side up. So positioned, the locator device will move in response to wave action, and thereby be more easily visible and recoverable and thereby reduce any subsurface hazard it otherwise might create while unattended or adrift. On the other hand, if the detached ski happens comes to rest upside down in the water i.e., with the shoe piece facing down in the water, the ski will tend to roll over and expose the brightly colored buoyant body.

To understand this, again consider FIG. 1(*c*), the general case of hydrostatic instability wherein the center of buoyancy C is lower than the center of mass M. Off the skier's foot, and upside down, the ski, and pouch assembly becomes a floating object similar to the generalized hull depicted in FIG. 1(i c). That is to say that any position in which the locator device is submerged under the ski will result in the center of buoyancy C of the assembly being under the assembly's center of mass M. Hence the assembly will tend to move under the action of a "couple" of the type generally described in conjunction with FIG. 1(*c*). Again, the fact that the buoyant body is positioned deep (by virtue of its being on top of the toe piece) in the water relative to the top surface of the ski tends to make the couple stronger than it would be if the buoyant body were closer to the ski's top surface. In any case, the result is a buoyant force pushing upward on the buoyant body while gravity pulls downward on the relatively heavier ski mass. Thus, in this upside down situation, the identical forces causing the hull to capsize in the FIG. 1(*c*) also will cause an upside down ski which has been suitably attached to Applicant's locator device to rotate or roll over and bring the floating ski to a position in which the pouch is above the ski i.e., to bring the assembly to a position wherein its center of buoyancy C is above center of mass M. Also, since the front cuff region will not normally be the center of mass of the ski, the positioning the locator device on top of the toe piece will also cause the ski to tend toward floating partially down by the stern i.e., with the pointed prow of the ski sticking out of the water. Thus the entire ski assembly as a whole is raised to reduce any subsurface hazard it might otherwise create while unattended or adrift. This condition also aids search operations. At the same time the pouch, now largely raised above the water surface, will move in response to wave action and thereby become more easily visible and recoverable.

DESCRIPTION OF THE DRAWINGS

Again, FIGS. 1(*a*), 1(*b*) and 1 (*c*) depict a generalized displacement hull 10 in various load situations.

DESCRIPTION OF THE PREFERRED EMBODIMENTS

Figure 1:
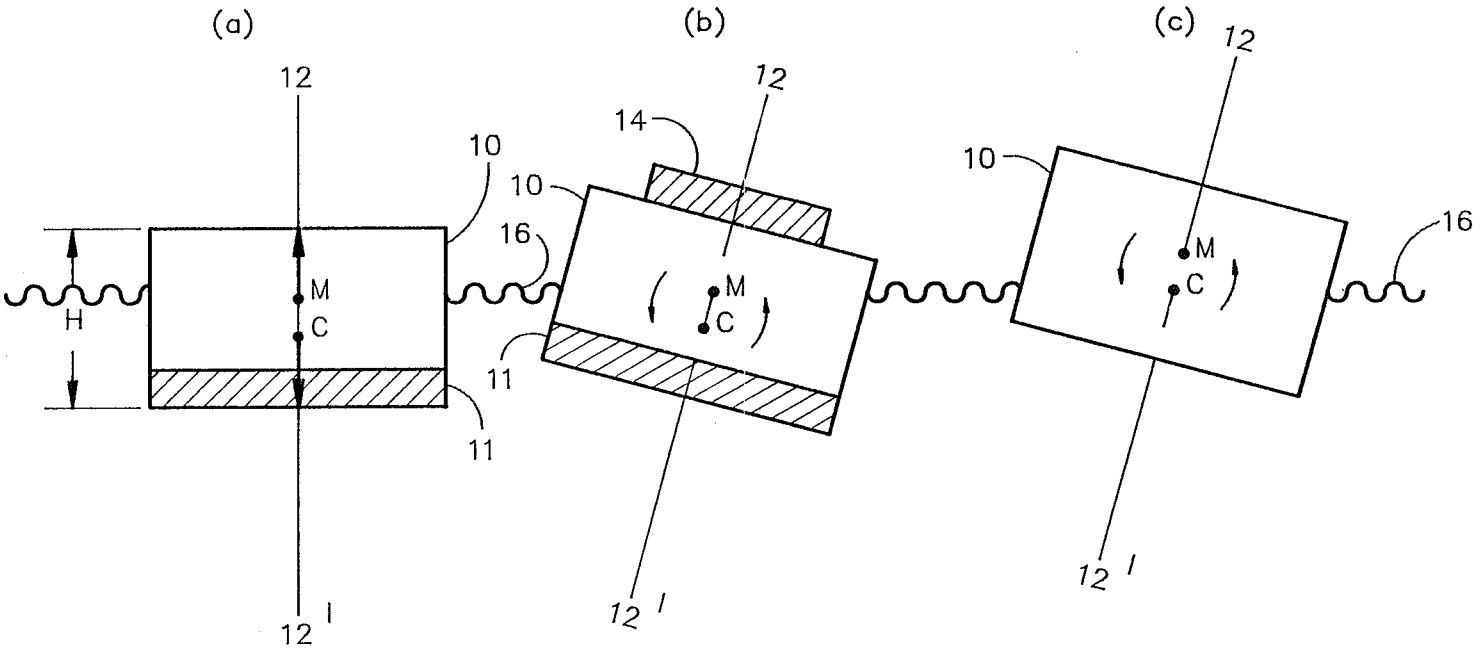
PRIOR ART Fig. 1

FIGS. 1(*a*), 1(*b*) and 1(*c*) depict various hydrostatic states of a highly generalized hull 10. FIG. 1(*a*) depicts a cross-section of a hull 10 having a load 11 in its bottom. The cross-section of said hull has a vertical center line 12—12' and a height H. The center of mass of the hull and load is depicted as point M. The center of buoyancy of the hull 10 as it rests in the water 16 is depicted as point C. For the reasons previously discussed, when the center of buoyancy C is higher than the center of mass M, a hydrostatically stable state is created.

FIG. 1(*b*) depicts the circumstance where a weight 14 is placed on top of the hull 10 to force the hull 10 down deeper into the water 16 and thereby displace a greater volume of said water. For the reasons previously discussed, this circumstance is hydrostatical unstable.

Figure 11:
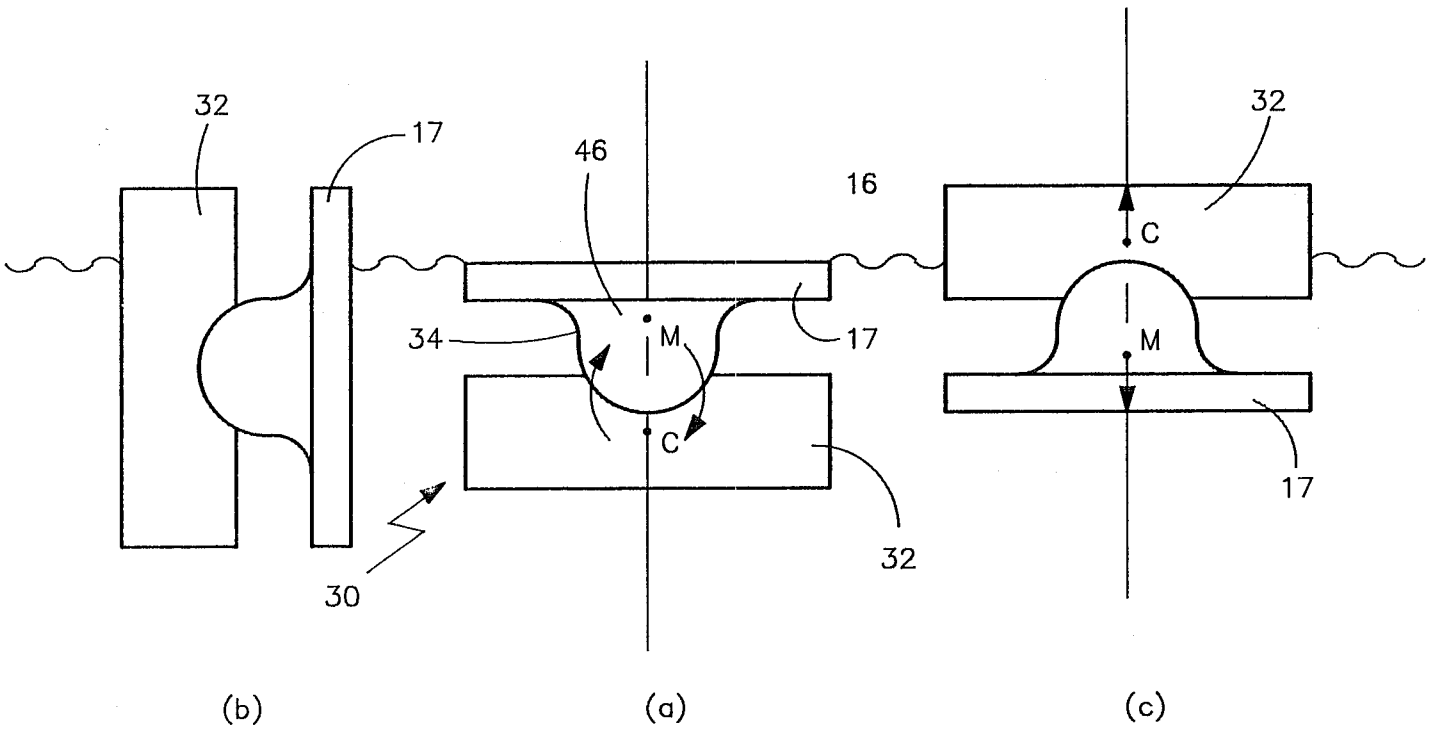
FIG. 11 shows the application of the principles shown in FIG. 1(*c*) to a locator device/ski assembly when the detached water-ski comes to rest upside down.

FIG. 1(*c*) depicts the circumstance where the hull is unloaded to such an extent that the hull floats high enough in the water that the center of mass M is higher than the center of buoyancy C. This situation is also unstable. As shown in FIG. 11, applicant's device is intended to create instability of this type if the ski should come to rest upside down.

Figure 2:
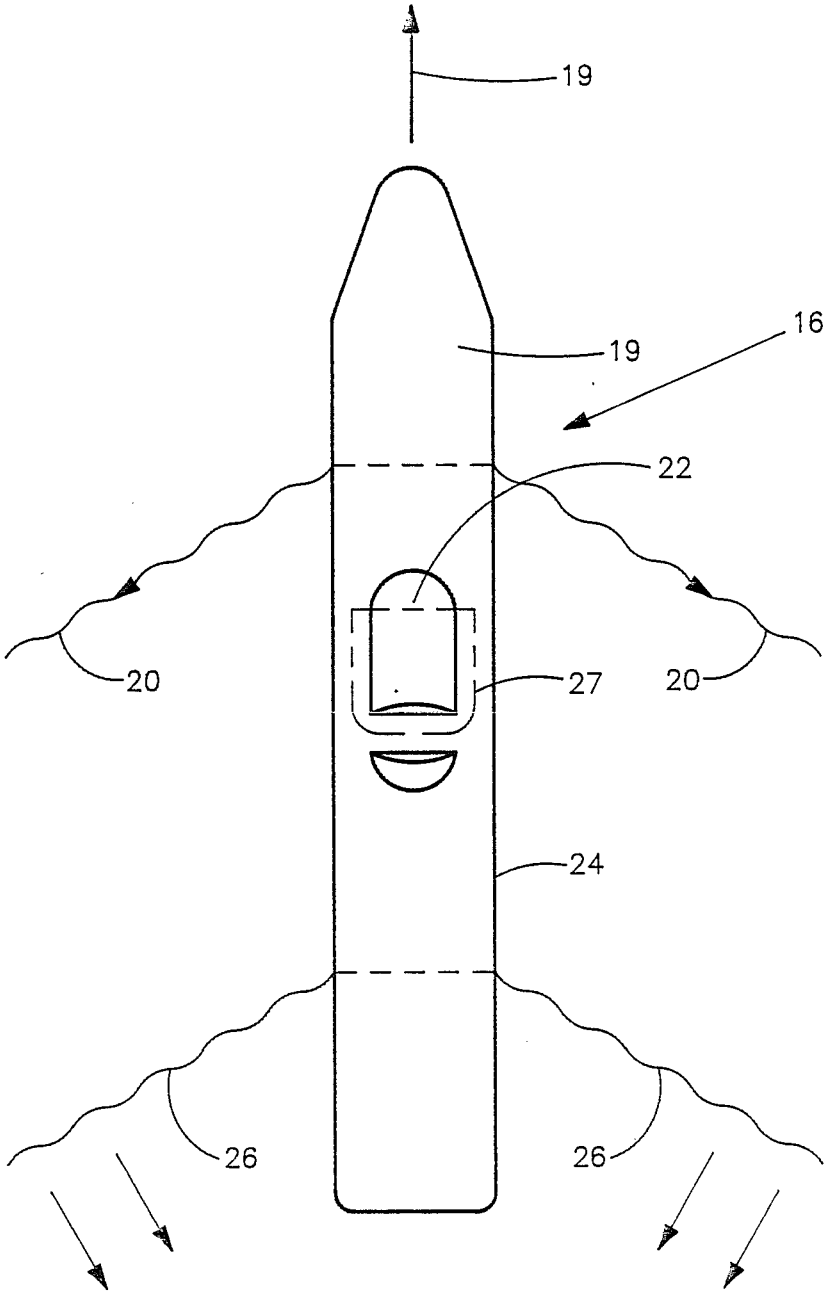
PRIOR ART Fig. 2
FIG. 2 shows a top plan view of the water surface and wave distribution of a water-ski as it is towed through the water.
Figure 3:
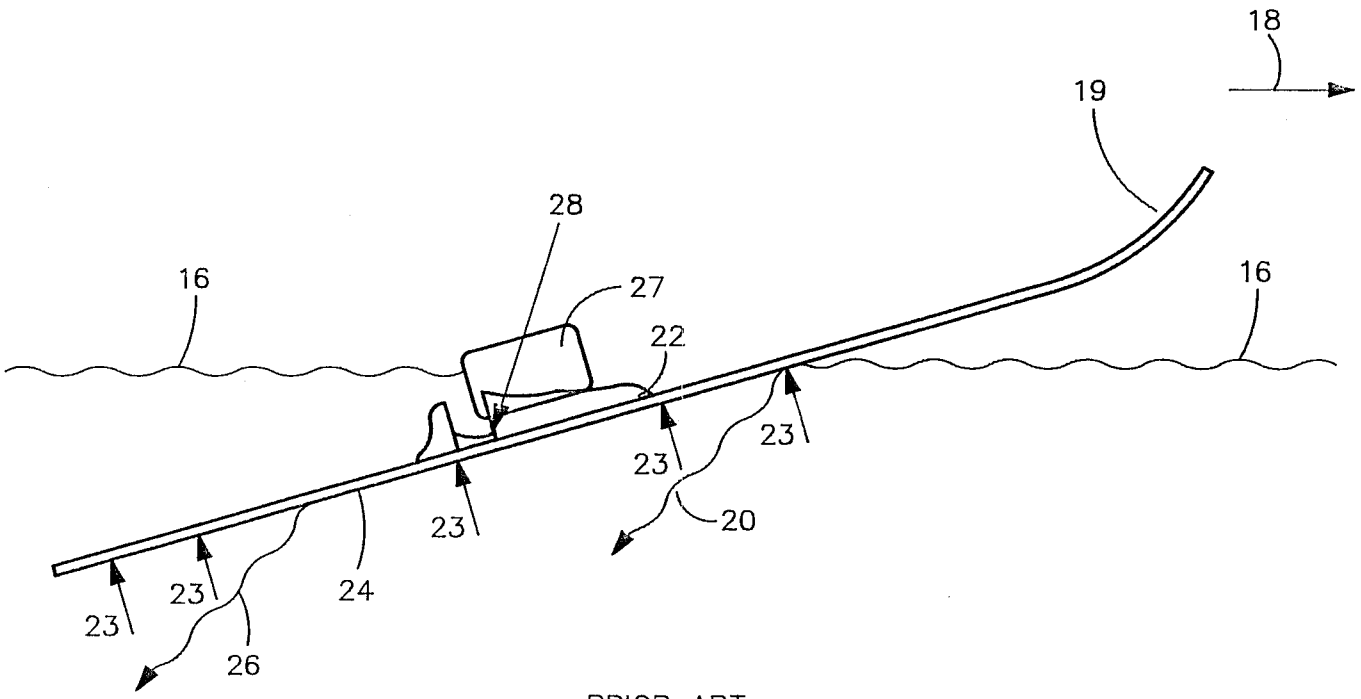
PRIOR ART Fig. 3
FIG. 3 shows a starboard elevation view of the action resulting from pulling a water-ski through a body of water.

FIG. 2 shows a plan view of a water-ski 19 under a pulling action 18 through a body of water 16. An outwardly directed bow wave 20 is created in front of the ski's toe piece 22. Hence, the front cuff region 27, generally located over the toe piece 22, is out of contact with the water. Maximum hydrostatic head starts to be delivered starting back from region 24 on the ski and this head culminates in a hull lifting super surface wave 26. FIGS. 2 and 3 are also specifically intended to show the general location of the front cuff region where the device of this invention is to be located with respect to a generalized prior art water-ski.

FIG. 3 shows a starboard side view of the water-ski 19 depicted in FIG. 2. Again, the water-ski 19 is under pulling action 18 by a boat, not shown, through a body of water 16. The length of the arrows 23 progress from bow to stern to indicate that, under these towing conditions, hydrostatic head builds up on the underside of the ski 19 from bow to stern. Such hydrostatic head 23 starts in the region of an outwardly directed bow wave 20 which starts in front of toe piece 22 and becomes strongest to the stern as a super surface wave 26 is formed. The dotted region 27 depicts a "front cuff region" which does not come into drag-creating contact with the water 16 and thus represents the general region where applicant's locator device is most advantageously positioned. Generally speaking the lower portion of this region should be about at the height 28 of the skier's ankle, e.g., about 1 to about 4 inches above the top surface of the ski 19.

Figure 4:
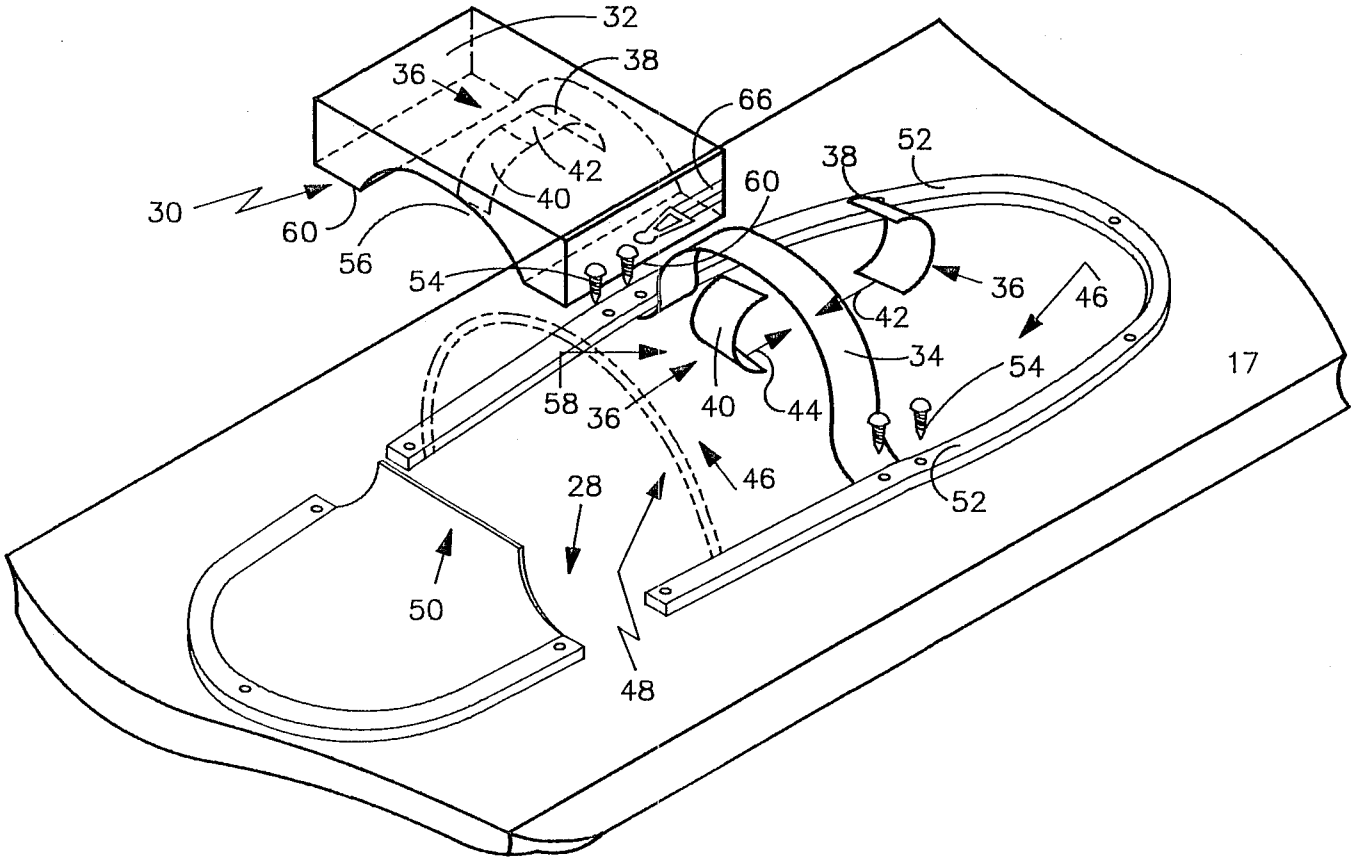
FIG. 4 shows an exploded, perspective view of a preferred locator device and a preferred method of attaching said device to a water-ski.

FIG. 4 is an exploded, perspective view of a water-ski 19 of a preferred embodiment of Applicant's water-ski locator device 30. The locator device 30 generally comprises a buoyant body 32 having a generally rectangular shape, a first strap 34 and a second strap 36 which forms a right strap 38 and a left strap 40. The second strap 36 is preferably attached to the underside of the buoyant body 32 in the center region 42 of the second strap 36. The right 38 and left 40 sides of the second strap 36 are shown both in phantom under the buoyant body 32 and in an exploded detail view above the first strap 34. Arrows 42 and 44 are intended to show the second straps 38 and 40 respectively can be passed under first strap 34. In other words, straps 38 and 40 pass between the bottom surface of first strap 34 and the top surface of the toe piece 46. No particular attachment means, e.g., Velcro fasteners, buckles etc., are shown with straps 38 and 40. Taken together the ski's shoe piece 48 is comprised of the toe piece 46 and a heel piece 50 in the manner of a "shoe". The toe piece 46 of a typical water-ski is typically held to the top surface of the water-ski 19 by means of a mounting plate 52 which generally holds down the outer perimeter of the toe piece 46. The left and right ends of the first strap 34 can be conveniently held down wit the same screws 54 which otherwise hold down the mounting plate 52. Hence the toe piece 46 is compressed under the toe piece 46, and thereby held in proper position.

Ideally the bottom of the buoyant body 32 is provided with a tunnel-like opening 56 which extends through the lower center region of the buoyant body 32. This tunnel region 56 is intended to fit over and largely coincide with the curved top surface 58 of toe piece 46. Generally speaking, the bottom surface 60 of buoyant body 32 will approximate the height of a point 28 where the skier's ankle (not shown) would be located when the skier's foot is in the shoe piece 48 and the buoyant body 32 is in its proper position in the front cuff region 27 shown in FIGS. 2 and 3.

Figure 5:
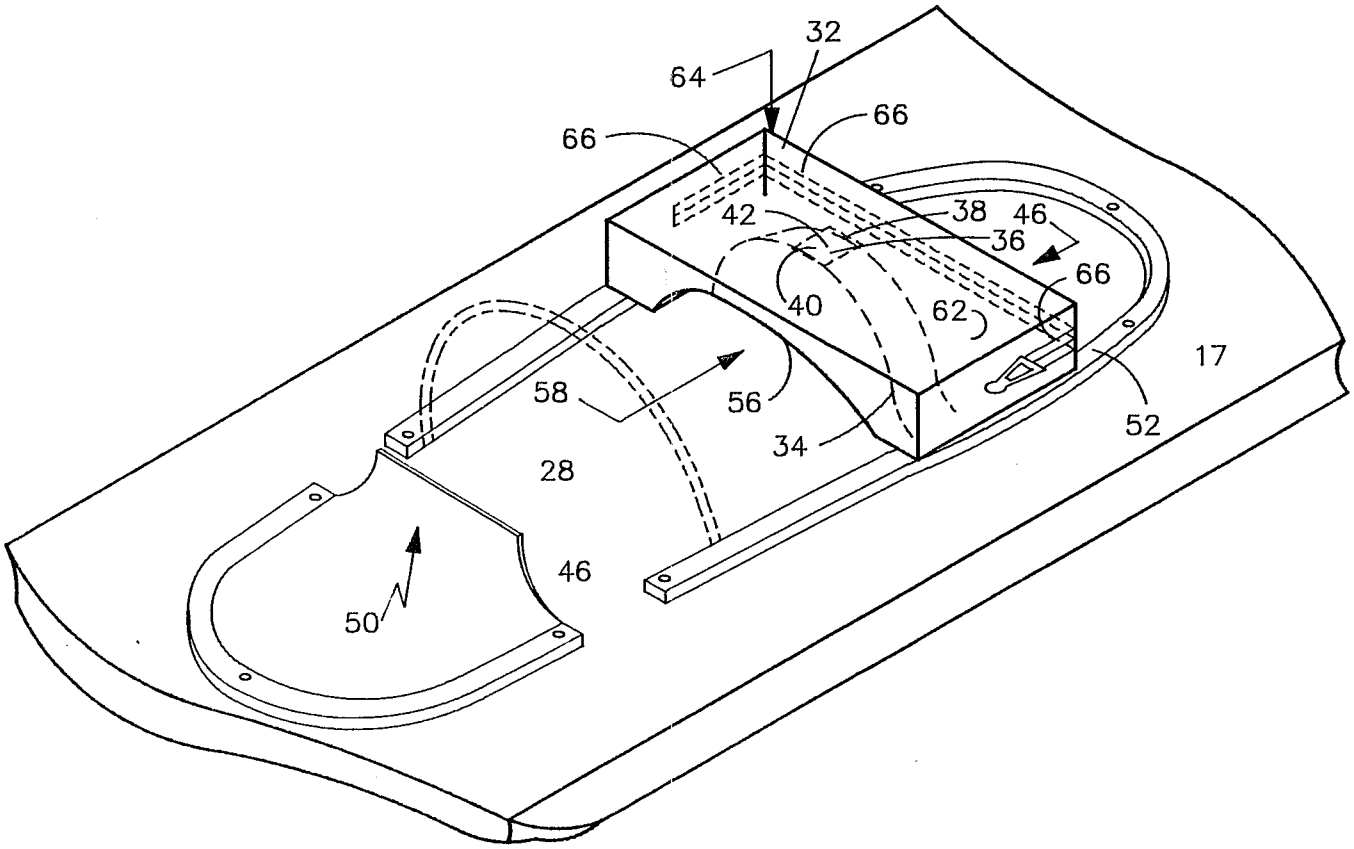
FIG. 5 shows a perspective view of the locator device positioned on the top of the ski's toe piece by the preferred method of attaching said device to a water-ski.

FIG. 5 shows the buoyancy body 32 depicted in FIG. 4 held in position over the toe piece 46 by means of a webbing system 62 comprised of a second strap 36 looped under the first strap 34. When the buoyancy body 32 is a pouch which houses a body of buoyancy material such as polyurethane, the pouch 64 can be provided with a zipper system 66 which extends around a portion of the outside of said pouch 64 and thereby allows the buoyant body to be placed in and taken out of the pouch.

Figure 6:
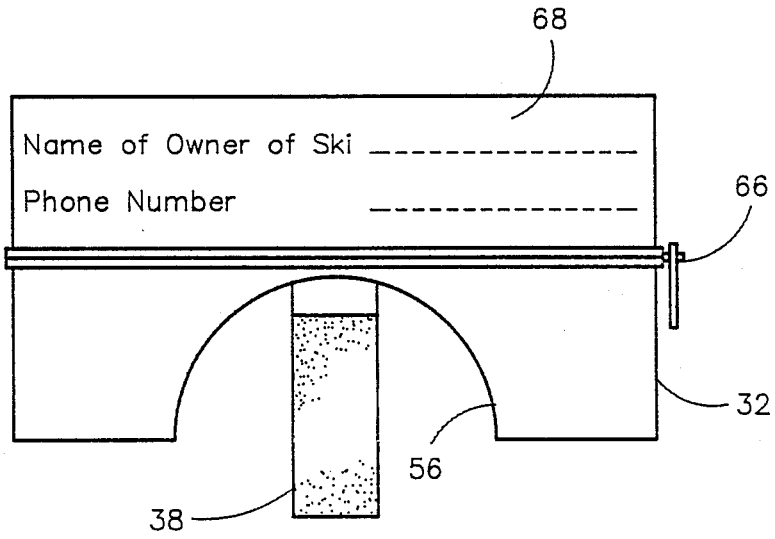
FIG. 6 is a front view of a preferred water-ski locator device made according to this disclosure.

FIG. 6 is a front view of the buoyant body 32 showing strap 38 suspended from the roof of the tunnel portion 56 of buoyant body 32. The upper front edge of the buoyant body is shown removed to form a face 68 upon which information such as the name and phone number of the ski's owner can be displayed.

Figure 7:
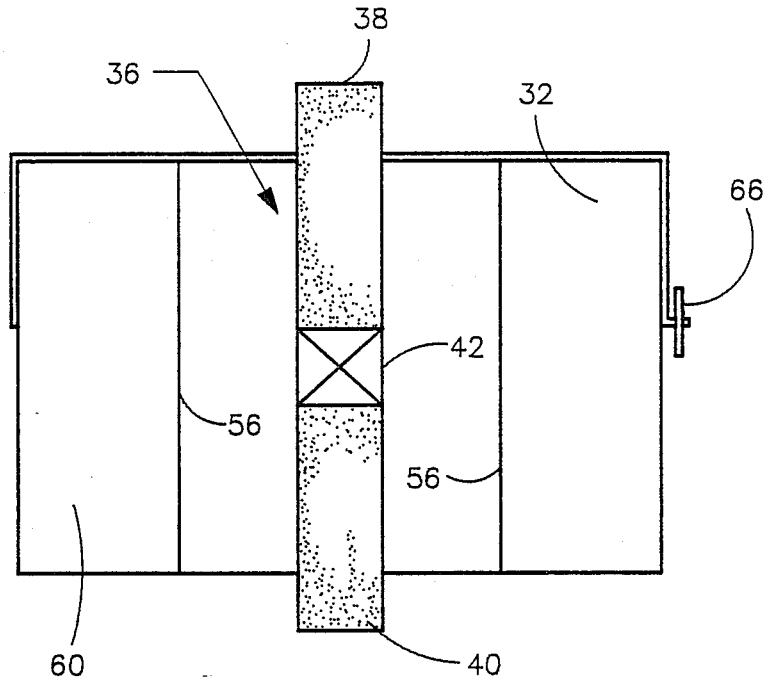
FIG. 7 is a bottom view of the preferred device

FIG. 7 is a bottom view of the buoyant body 32 showing strap 36 attached (e.g., attached by sewing) to the top of tunnel 56 to form a right strap portion 38 and a left strap portion 40.

Figure 8:
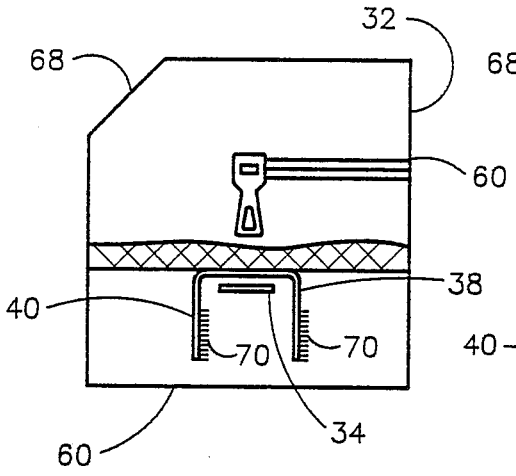
FIG. 8 is a side view of the preferred embodiment of the locator device wherein a second strap which is attached to the pouch, is shown unattached to a first strap which arches over the toe piece.

FIG. 8 is a side view of the buoyant body 32 showing the face 68 of the buoyant body and showing the second straps 38 and 40 provided with a highly generalized velcro fastener means 70.

Figure 9:
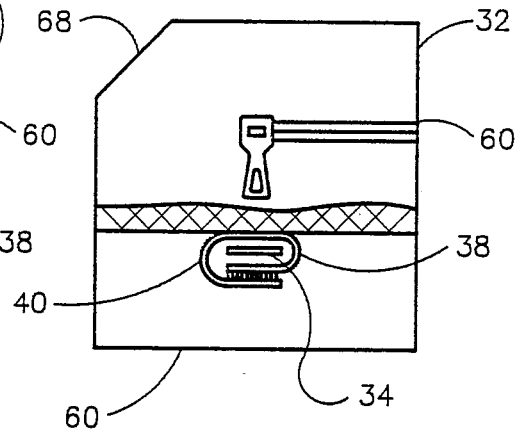
FIG. 9 is a side view of the water-ski locator device shown with its second strap shown encompassing the first strap which arches over the ski's toe piece.

FIG. 9 is a side view showing straps 38 and 40 wrapped around first strap 34.

Figure 10:
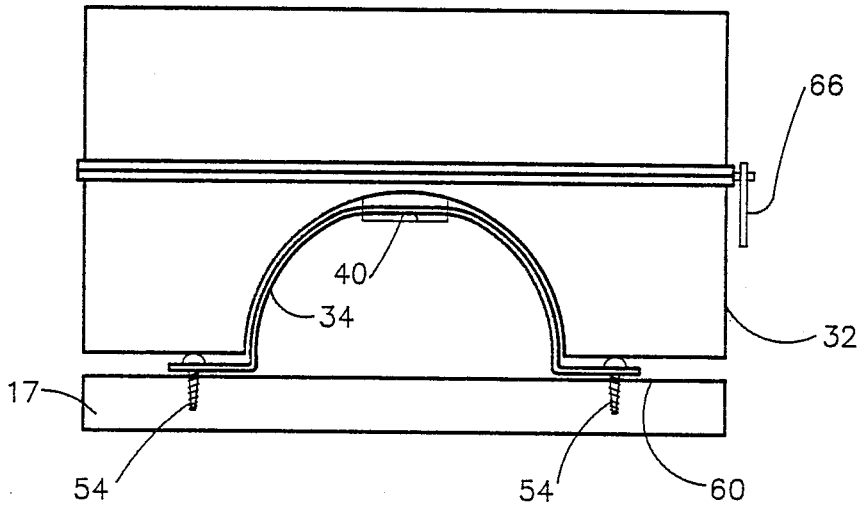
FIG. 10 is a front view of the preferred embodiment showing the second strap encompassing the first strap which arches over the toe piece.

FIG. 10 is a front view of the buoyant body 32 showing second strap 40 wrapped around the toe piece arching first strap 34.

FIG. 11 is a cross-section view of a water-ski locator device 30 attached to a ski 19. The ski 19 is shown upside down in the water 16. FIG. 11 depicts the application of the "coupling" or instability principle depicted in FIG. 1(*c*) to the upside down ski when its buoyant body is facing down in the water.

Figure 12:
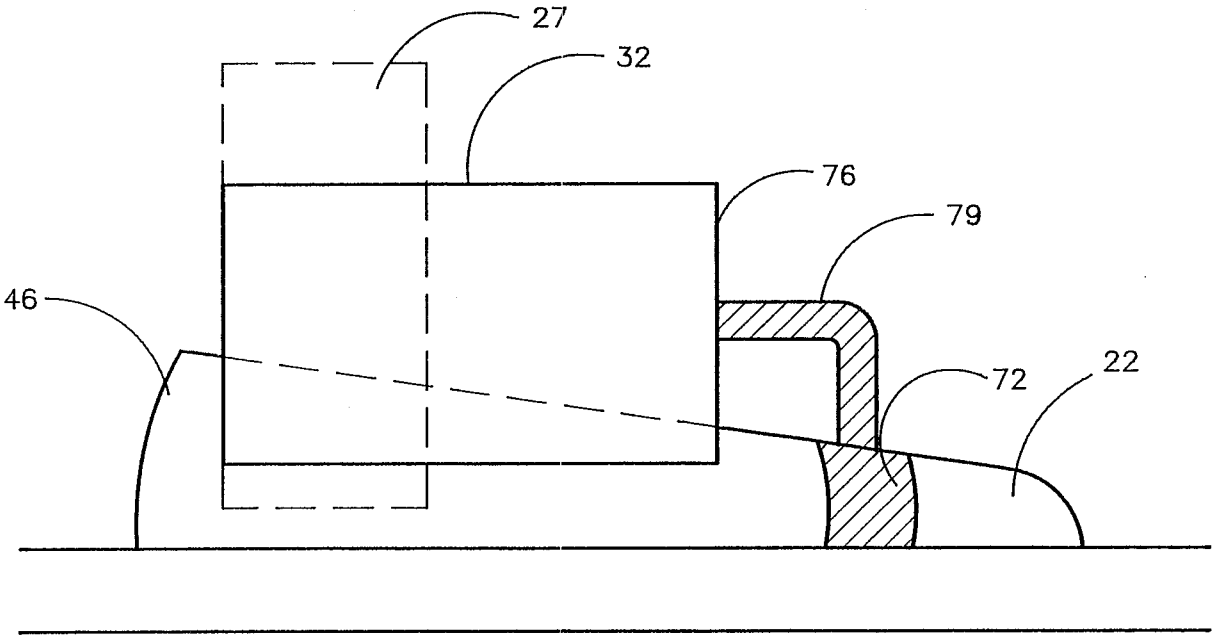
FIG. 12 shows an alternative arch and rib system for positioning the pouch near the front cuff region.

FIG. 12 depicts an alternative means for positioning a buoyancy device 32 on top of toe piece 22 in the front cuff region 27. In this alternative method, a rubber strap 72 is provided with a semi-flexible rib 79 which projects from the top, surface of the strap 72. The strap 72 and rib 79 will preferably comprise a single unit and be attached to the buoyant body 32 in such a manner (e.g., the rib is attached to the front surface 76 of the buoyant body 32) so as to place the buoyant body 32 in the desired front cuff region 27.

While the herein disclosed invention has been described according to a few specific embodiments hereof, it will be understood that it is capable of further modification, and this patent application is intended to cover any variations, uses or adaptions of the invention following, in general, the principles of the invention and including such departures from the present disclosure as come within known or customary practice in the art to which the invention pertains, and as fall within the scope of the invention or the limits of the appended claims.

Thus having disclosed my invention, I claim:

1. A water-ski locator device for use in association with a conventional water ski having a toe piece with a front cuff region adapted to removably secure the front portion of the skier's foot to said ski, said water-ski locator device comprised of a buoyant body, having a pouch filled with a buoyant material, and positioning means securing the buoyant body to the front cuff region on top of the toe piece.

2. The water-ski locator device of claim 1 wherein the positioning means is comprised of a first strap arching over, and attached to each side of, the toe piece and a second strap which is attached to the underside of the buoyant body and which loops under the bottom of the first strap.

3. The water-ski locator device of claim 1 wherein the positioning means is comprised of an arch whose top surface is provided with a semi-flexible rib which is attached to the buoyant body in such a manner that the buoyant body is positioned in the front cuff region.

4. A water-ski locator device comprised of:

(1) a generally rectangular block of solid, buoyant material housed by a pouch, (2) a first strap which arches over the top surface of a water-ski toe piece, thereby forming a loop, and whose two ends are respectively attached to the left side and right side of said toe piece and whose under surface is provided with a, velcro engaging surface;

(3) a second strap having a central portion attached to the underside of the pouch and having two ends which are capable of being looped under the arch formed by the first strap and wherein the two ends are provided with, velcro engaging surfaces so that said two ends can be joined to each other after at least one of said two ends passes under the loop formed by the first strap.

5. The water-ski locator device of claim 4 wherein the block of solid, buoyant material and the pouch are provided with a tunnel-like opening which rests upon the top surface of the toe piece.

6. The water-ski locator device of claim 4 wherein the block of solid, buoyant material and pouch each have a truncated edge which forms a face and the face of the pouch is adapted to receive written information concerning said device.

* * * * *